United States Patent [19]

Johnson

[11] 4,065,868

[45] Jan. 3, 1978

[54] REVOLVER SPEED LOADER

[76] Inventor: David A. Johnson, 5245 Sturdivant, Klamath Falls, Oreg. 97601

[21] Appl. No.: 739,087

[22] Filed: Nov. 5, 1976

[51] Int. Cl.[2] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 1,228,505 | 6/1917 | Wesson | 42/89 |
| 1,480,812 | 1/1924 | Bazan | 42/89 |
| 1,929,440 | 10/1933 | Miano | 42/89 |
| 2,399,904 | 5/1946 | Baucum | 42/89 |
| 2,944,359 | 7/1960 | Hanley | 42/89 |
| 3,197,907 | 8/1965 | Olson | 42/89 |
| 3,503,150 | 3/1970 | Brunhuber et al. | 42/89 |
| 3,541,716 | 11/1970 | Fordham et al. | 42/89 |
| 3,722,125 | 3/1973 | Switzer | 42/89 |

*Primary Examiner*—Charles T. Jordan
*Attorney, Agent, or Firm*—Chernoff & Vilhauer

[57] ABSTRACT

A holder for releasable securement of cartridges in condition for simultaneous loading of the cartridges into the chambers of a revolver's cylinder. The holder comprises a cylindrical body having a plurality of axially extending, radially distributed cartridge-receiving bores adapted to align with and introduce the rounds into the revolver's cylinder chambers. The holder also includes a manually operated cartridge engagement member for axial and rotary movement within the holder body centrally of the bores and having a double star sprocket system whose lateral projections releasably lock each cartridge flange while laterally supporting each cartridge body within the holder in a position of parallelism with a center bore. The holder further includes protected means for releasing the double star sprocket system and thereby releasing the cartridges, when the cartridge ends are in the revolver's cylinder chambers, in response to the pressing of the holder against the rear of the revolver cylinder.

8 Claims, 19 Drawing Figures

REVOLVER SPEED LOADER

BACKGROUND OF THE INVENTION

The present invention relates to improvements in plural cartridge holders and is particularly directed to cartridge holders adapted to releasably secure cartridges for fast and simultaneous loading of the cartridges into the chambers of a revolver, or the like.

Initial efforts to develop a quick reload device for revolvers antedate the present invention by many decades, as evidenced by the disclosure in 1879 of Bell U.S. Pat. No. 223,100, and have continued periodically up to the present year. Such activity has been stimulated by police officers and the like who have insisted that such a device be foolproof and positive in its operation because their lives may at any moment depend upon its operation.

As a loading device of this type must be manually preloaded, some type of holding means must be incorporated in its structure to hold the cartridges therein until they are released during the loading or reloading of the revolver. Therefore, a holding means as well as release means are common to devices of this nature; and the release generally requires the application of a force directed inwardly or outwardly in some manner. Devices developed prior to the present invention have failed to satisfactorily resolve problems associated with the hold and release mechanisms.

One factor which precluded satisfactory operation of earlier devices was the failure to guard against premature release. The plural cartridge holders of Baucum U.S. Pat. No. 2,399,904, Hanley U.S. Pat. No. 2,944,359, and Olson U.S. Pat. No. 3,197,907, for example, are all especially subject to accidental release of one or more cartridges by the accidental application of pressure to the release mechanism. Baucum attempts to minimize the occasions of premature release by providing special carrying containers for his cartridge holder; however, unless care is exercised from the time immediately preceding installation into the container, and from the time following removal from the container up to insertion in the revolver's chambers, accidental release can still occur.

The earlier Bell device provides a potential solution to the accidental release problem by employing unitary construction, in that the cartridge holder's cartridge-receiving chambers and the locking mechanism are one solid piece and, hence, the release can be obtained only by holding the cartridges while the holder is rotated. It will be seen that this is a combination of events which is unlikely to occur inadvertently. However, this solution is purchased with unitary construction which presents other severe problems, e.g. biasing means accentuates a cartridge tilt problem hereinafter more fully described, and some potential for premature release remains.

Another factor that precludes satisfactory operation of earlier devices is that when the release force is applied in haste, it can often be directed off center or in some manner so as to cause one or more of the cartridges to become misaligned or cocked in the loading device. Since these devices, with few exceptions, depend upon the forces of gravity to carry the cartridges into the revolver's cylinder chambers, such cartridge cocking can result in cartridge recapture by the loading device when the releasing force is relaxed. The net result is that one or more of the revolver's cylinder chambers might not receive a cartridge.

The device shown in the Fordham et al U.S. Pat. No. 3,541,716 presents at least a partial solution to the cartridge cocking problem by using a release mechanism that positively urges the cartridges slightly past a retaining O-ring; hence, even when some force is applied off center or in some other manner so as to cause one or more of the cartridges to become tilted or cocked, they cannot become re-engaged by the O-ring holding means when the force is relaxed. However, the remainder of the cartridge expulsion still depends upon the forces of gravity and, hence, the problem is not fully resolved. Moreover the solution is obtained by adopting means susceptible to premature release.

Yet another difficulty with some of the earlier devices is caused by the use of resilient washers, such as O-rings or the like, which require either a very substantial degree of flexing during operation or are adversely affected by extreme temperature vacillations and, thereby, suffer from fatigue rapidly and become inoperable.

Even though the problems of premature release, unitary construction, partial recapture of cartridges, tilted cartridges which fail to clear the holder, and other problems not stated reveal serious deficiencies in earlier devices, perhaps the most important problem, common to all earlier devices, is the tilting of the cartridges in the holder which make cartridge entry into the revolver's cylinder chambers difficult and, thereby consumes precious time.

Each of the earlier devices retains cartridges in the holder by clamping the flanges of the cartridges in various ways. Since the mass of each cartridge is not given lateral support, each cartridge is urged or permitted to tilt away from the center of its chamber. Rapid delivery of a round from the cartridge holder to the revolver's cylinder chambers requires not only registration with the spatial alignment of the cylinders, but also with the angle of entry. Cartridge tilt within the cartridge holder operates to diminish either one of these relationships or both. Moreover, the absence of lateral support increases the ability of an external force to tilt a cartridge in its holder chamber or to dislodge the cartridge from the holder.

SUMMARY OF THE INVENTION

The present invention relates to improvements in plural cartridge holders and is particularly directed to cartridge holders adapted to releasably secure cartridges for fast and simultaneously loading of a plurality of cartridges into the chambers of a revolver, or the like.

An object of the present invention is to provide a plural cartridge holder that is readily charged with a group of cartridges in a minimum of time and which has a quick, positively operated means for releasably securing the cartridges therein. In the preferred embodiment of the present invention the holder may be easily charged by dropping cartridges into their chambers, then pushing in and rotating a locking knob clockwise approximately 30°.

Still another object of the present invention is to provide a plural cartridge holder which has a quick, positively operated release means for charging the cartridges simultaneously into the chambers of a revolver in response to the engagement of the release means with the revolver's cylinder. In the preferred embodiment of the present invention, after the rounds have been aligned and partially inserted into the chambers of the revolver's cylinder, the entire loader is then pushed against the rear of the revolver's cylinder until resulting pressure forces the release means to move inwardly while rotating automatically to release the rounds into the revolver's cylinder chambers.

Yet a further object of the invention is to provide a plural cartridge holder which may be subjected to an inordinate amount of rough handling without releasing the cartridges therefrom. In the preferred embodiment of the present invention the release mechanism is protected from external forces by being situated between and recessed inwardly from the ends of the cartridges. The release mechanism must be subjected to a substantial direct force applied only in the constricted central area between the radially located cartridges in order to move the mechanism sufficiently inward to effectuate the rotating release action. The only unprotected portion of the release mechanism is the locking knob which must be subjected to a substantial direct pulling force, and then be rotated to effect the release of the cartridges. Such pulling force is unlikely to occur inadvertently. The cartridge holder therefore may be thrown upon the floor or bumped against other surfaces at a plurality of angles and with substantial force without thereby causing accidental release of the cartridges.

Still a further object of the invention is to provide a plural cartridge holder in which the rounds will be maintained in alignment with the cylinders of a revolver both spatially and angularly, thus making the reloading faster and more reliable and further assuring that the cartridges cannot be dislodged from the holder. In the preferred embodiment of the present invention, the cartridges are urged inwardly by a spring-loaded rear star wheel locking sprocket, which also prevents their accidental dislodgment from the holder, while a front star wheel sprocket provides lateral outward opposing support to the mid-portions of each round, thereby positioning and holding each round in the proper parallel relationship to the chambers of the revolver's cylinder.

Yet a further feature of the present invention is to provide a plural cartridge holder that is lightweight, extremely rugged and reliable yet easily and inexpensively produced. In the preferred embodiment of the present invention, the cartridge holder is composed of a polycarbonate having 12 percent "Teflon" fluorocarbon resin therein for lubrication. Such material is easily molded into a hard durable cylinder which will absorb considerable shock and rough treatment without appreciable damage thereto. It will be understood, however, that other materials including aluminum could be substituted therefor without departing from the essence of the invention as disclosed by the appended claims.

Yet further features and advantages of the present invention will become apparent, and the full nature of the invention will be more readily understood from the accompanying drawings and the following descriptions and claims.

DETAILED DESCRIPTION OF THE INVENTION

Figure 1:
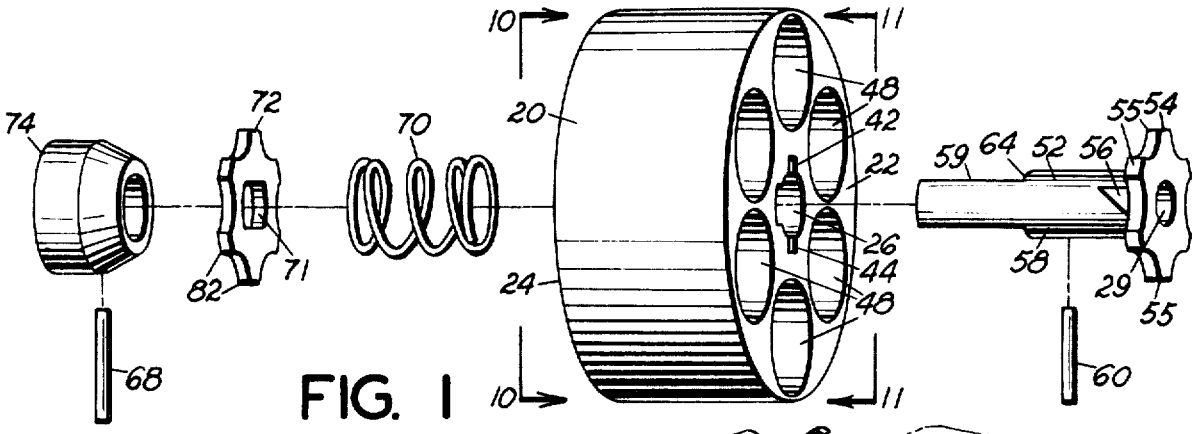
FIG. 1 is an exploded view of the loader.

With particular reference to FIG. 1, a preferred embodiment of the present invention is set forth wherein the numeral 20 indicates cylindrically shaped body member composed of polycarbonate having about 12 percent "Teflon" fluorocarbon resin therein for lubrication, and having opposed surfaces 22 and 24 that are referred to herein as "front" and "rear", respectively.

Figure 10:
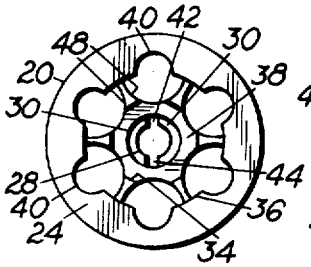
FIGS. 10–11 are rear and front views, respectively, of the body portion of the loader taken along lines 10—10 and 11—11 of FIG. 1.
Figure 11:
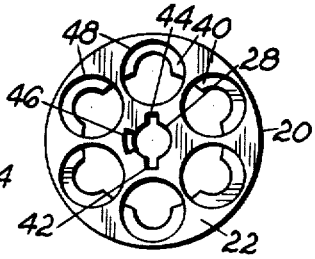

A four-diameter center bore, indicated generally as 26 in FIG. 1, is formed through the axis of the body member 20. With reference to FIGS. 10 and 11, the center bore has a relatively small first diameter front portion 28 and a larger second diameter portion 30 which form between them a first shoulder 32, and further has a relatively large third diameter portion 34 and an even larger fourth diameter portion 36, the second diameter portion and the third diameter portion forming a second shoulder 38.

Figure 14:
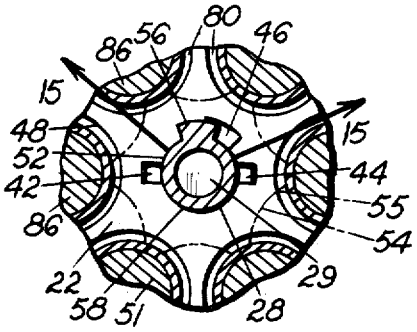
Figure 15:
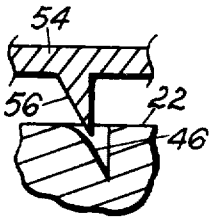
FIG. 15 is a radial developed sectional view, taken along line 15—15 of FIG. 14, showing the cam portion on the shaft member prior to release of the cartridges.
Figure 19:
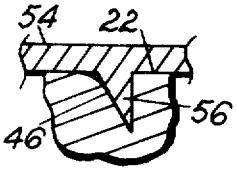
FIG. 19 is a radial developed sectional view, taken along line 19—19 of FIG. 18, showing the cam portion of the shaft in the engaged position with the body portion of the loader.

The first diameter portion 28 has first and second opposing locking pin grooves 42 and 44 that extend to the full length of the portion 28 and inwardly to the depth of the second diameter portion 30. The first diameter portion further has a cam surface groove 46, as also shown in FIGS. 14 and 15, that takes the form of a rectangle at the front major face 22 and thereafter forms a triangular wedge which angles from the left side of the rectangular portion towards the second locking pin groove 44 and extends longitudinally for slightly more than half of the length of the first diameter portion 28.

Figure 12:
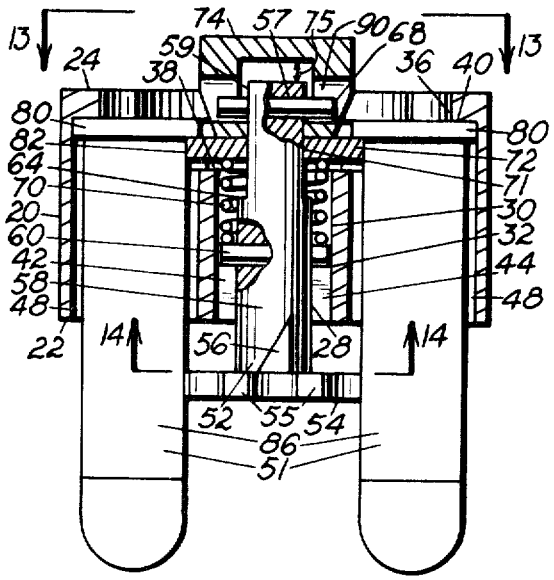
FIG. 12 is a partially cross sectional view of the loader in the locked position loaded with cartridges.

The body member 20 also has a plurality of radially distributed, regularly spaced apart cartridge-receiving bores 48 which have their center lines in parallelism with the center bore 26. Each bore has a diameter which is slightly larger than the diameter of the peripheral flanged edges 80 of a cartridge 51 (FIG. 12). At the rear of each bore is a flange 40 (FIGS. 11, 12 and 16) forming a supporting partial shoulder near the rear surface 24. The bores 48 are, therefore, each adapted to receive and support a cartridge 51 and are formed in the body member 20 for simultaneous alignment with the chambers in the cylinders of conventional revolvers.

As best seen in FIGS. 2-7 of the drawings, the body member 20 of the preferred embodiment of the present invention has an actual length that permits reception into the body member of slightly more than half of a cartridge case for the purposes to be hereafter set forth.

Figure 16:
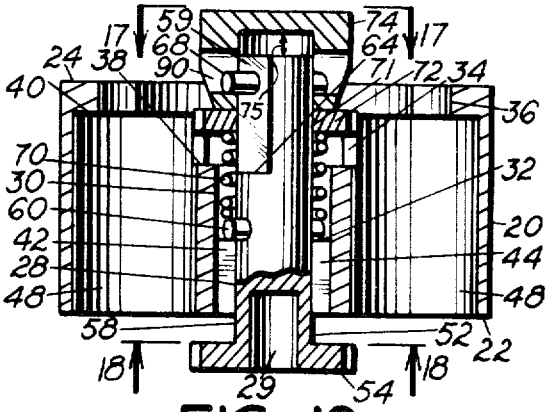
FIG. 16 is a cross sectional view of the loader in the empty condition.

Referring now to FIGS. 1, 12 and 16, an operating shaft 52 is mounted in the center bore 26 for oscillating longitudinal and rotating movement therein and comprises an integral front star wheel sprocket 54, an integral triangular wedge cam 56 for mating with the cam surface groove 46, and an integral shank portion 58. The shank portion 58 has a transverse bore therethrough spaced longitudinally from the front star wheel sprocket 54 wherein a locking cross pin 60 is positioned. The pin 60 engages the first shoulder 32 of the center bore 26 and defines stops for the oscillatory movement of the operating member 52.

The end portion of the shaft 52 is flattened on two sides, the flattened portion beginning adjacent the locking cross pin 60 and forming a shoulder 64 in the shaft 52. In close proximity to the end of the shaft 52, the flattened portion contains a second transverse bore 57 wherein a tubular pin 68 may be inserted.

To assemble the device, the shaft 52 with the cross pin 60 therein is inserted through the front surface 22 into the center bore to the position shown in FIG. 16. The locking pin grooves 42 and 44 permit such insertion, after which the shaft 52 is rotated to prevent withdrawal. Once the shaft 52 has been inserted into the center bore 26, assemblage is completed by: first placing a spring 70 onto the shaft from the rear surface 24 so that it rests upon the pin 60; next placing a rear star wheel sprocket 72 having a central aperture 71 for mating with the flattened end portion 59 onto the shaft 52 so that it rests upon spring 70; then placing an enlarged lock actuator head 74, having an enlarged lateral bore 90 therethrough, upon the shaft member 52 so that it rests upon the rear star wheel sprocket 72 and slightly depresses spring 70; and finally securing the lock actuator head portion 74 on the shaft 52 by inserting a tubular pin 68 through the lateral bore 90.

Figure 2:
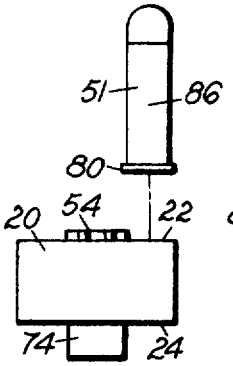
FIGS. 2–4 depict simplified plan views of the loader showing sequentially the manner of insertion and locking of cartridges into the device.
Figure 3:
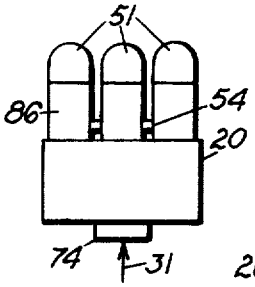
Figure 4:
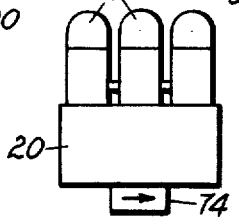

The operation of the foregoing parts will now be described with respect to FIGS. 2-9 as well as the other figures. FIGS. 2-4 depict the series of events which are necessary to charge the holder of the present invention with a plurality of cartridges. FIG. 2 depicts the first sequence which is holding the body member 20 in one hand with the front surface 22 uppermost while with the other hand the cartridges 51 are inserted into the plurality of bores 48 so that their peripheral flanged edges 80 rest upon the flange 40 at the rear of the bores. Referring now to FIG. 3, in the next sequence the lock actuator head 74 is pushed inwardly against the force of the spring 70 as indicated by the arrow 31. Thereafter locking of the cartridges in the bores is accomplished by rotating the lock actuator 74 clockwise approximately 30 degrees while it is so depressed.

Figure 13:
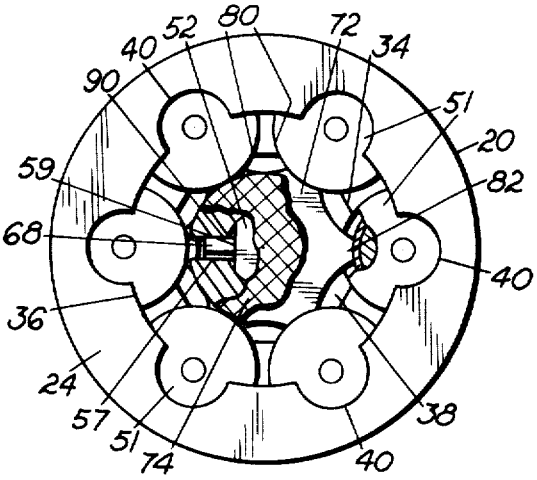
FIGS. 13–14 are views taken along lines 13—13 and 14—14, respectively, of FIG. 12, with certain portions broken away for clarity.

With more particularity and referring now to FIGS. 12 and 16, it will be seen that inward pressure on the lock actuator 74 compresses spring 70 and slides the rear star wheel sprocket 72 forwardly on the operating shaft 52, thereby causing the radial extended portions 82 of the rear star wheel sprocket 72 to move forwardly of the cartridge flanged edges 80. The forward movement of the lock actuator 74 with respect to the shaft 52 is made possible by the oversized diameter of the lateral bore 90 with respect to the pin 68, and the clearance space 75 between the actuator 74 and end of the shaft 52 as shown in FIGS. 12 and 16. In this forward position of the lock actuator 74 and rear star wheel 72, the operating shaft 52 is still in the rotational position shown in FIGS. 16-18. The shaft 52 is then rotated about 30 degrees clockwise by way of the lock actuator 74 thereby locking the radial extended portions 82 of the rear star wheel 72 in front of the cartridge flanges 80 as shown in FIGS. 12 and 13. The rearward force of the spring 70 against the rear star wheel 72 leverages the cartridges against the flange 40 when the inward locking force is relaxed, thereby tending to urge the cartridges toward the center bore.

The foregoing rotation of the lock actuator head 74 also simultaneously moves the radial extended portions 55 of the front star wheel sprocket 54 against the midportion 86 of each cartridge 51 as shown in FIGS. 12 and 14 thereby applying an outward lateral supporting force in opposition to the inward urging of the cartridges by the rear star wheel 72 and thereby positioning and holding the cartridges 51 firmly at the center of their respective bores 48 as shown in FIG. 12 in a position of parallelism with the center bore. It is important to note that, with the cartridges locked in the body member 20, the front star wheel 54 is recessed with respect to the leading ends of the cartridges so as to be protected thereby for reasons to be explained hereafter.

Figure 17:
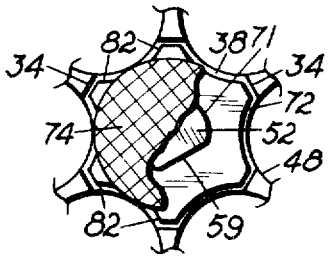
FIGS. 17–18 are detailed sectional views taken along the lines 17—17 and 18—18, respectively, of FIG. 16.
Figure 18:
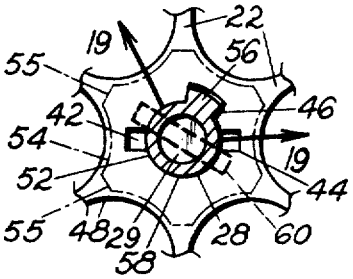

The clockwise rotation of the lock actuator 74 also rotates the cross pin 60 from the position shown in FIGS. 16-18 to the position shown in FIGS. 12 and 13, aligning the pin with the grooves 42 and 44 and allowing the pin 60, shaft 52 and front star wheel 54 to move forwardly under the pressure of the spring 70. This forward movement seats the pin 60 in the grooves 42 and 44 and prevents unlocking rotation of the operating shaft 52 until the shaft 52 is subsequently moved rearwardly.

Figure 9:
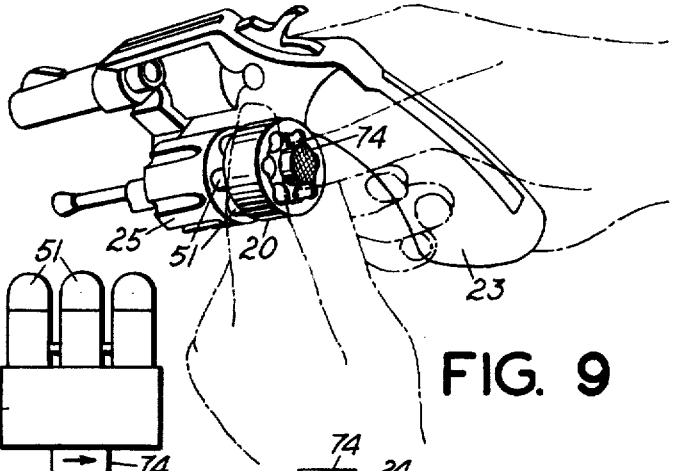
FIG. 9 depicts a rear view of a conventional revolver with the cartridge chamber spun out 90° and ready for reloading.
Figure 5:
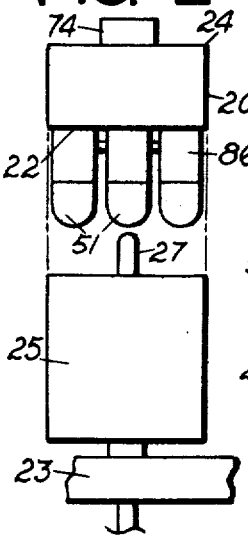
FIGS. 5–8 depict simplified plan views showing sequentially the manner of insertion of the loaded device into a revolver's chambers and the manner of release of the cartridge into the chambers of the revolver.
Figure 6:
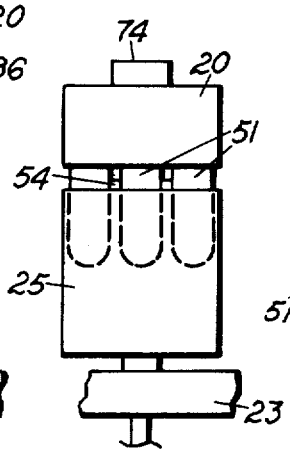
Figure 7:
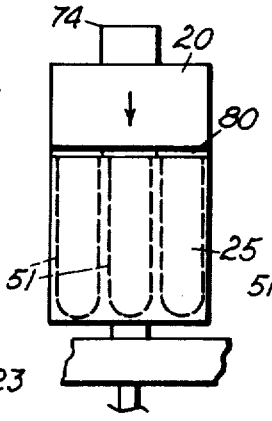
Figure 8:
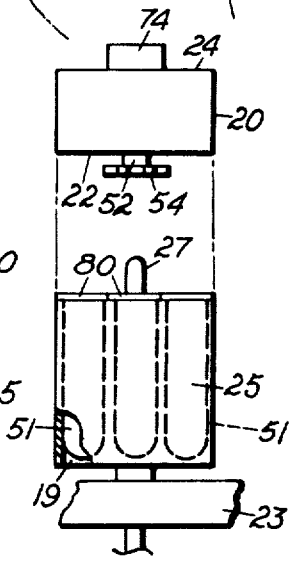

Once the holder has been charged with a plurality of cartridges, the holder may then be placed on the person for instant loading or reloading of a revolver cylinder as shown in FIG. 9. The revolver cylinder 25 may be quickly and easily loaded with cartridges 51 simply by starting the cartridges into the cylinder chambers 19 and then pressing the body member 20 forwardly against the revolver cylinder. With more particularity and referring now also to FIGS. 5-9, the charging sequence begins with the placement of the leading ends of the cartridges 51 into the cylinder chambers 19. If the revolver cylinder has a rearwardly protruding male member such as 27, the male member will be able to mate with a female socket 29 (FIG. 16) in the center of the front star wheel 54. Each cartridge enters its respective cylinder chamber 19 as depicted in FIGS. 5 and 6. The body member 20 is then pressed down against the revolver cylinder 25 as depicted in FIG. 7 until the cartridges are released from the holder and positively urged out of their respective bores 48 by pressing engagement of the cylinder 25 against the front star wheel 54 as will be hereinafter more fully shown and described. Once the loader has inserted the cartridges into the cylinder chambers, the empty body member 20 may then be removed from the cylinder 25 as depicted in FIG. 8.

Referring now to FIGS. 14-19, it will be seen that as the body member 20 is pressed against the revolver cylinder 25 the resulting rearward pressure of the center of the cylinder against the front star wheel 54 moves the operating shaft 52 rearwardly against the force of the spring 70 until the locking cross pin 60 clears the locking pin grooves 42 and 44. Increased pressure at this point forces cam 56 to bear upon the cam surface 46 in such a manner as to cause the operating shaft 52 to rotate approximately 30° back to its unlocked position of FIGS. 16–18. This rotation of the operating shaft 52 simultaneously: removes the radial extended portions 82 of the rear star wheel sprocket 72 from the flanged edges 80 of the cartridges 51 thereby releasing the cartridges; removes the radial extended portions 55 of the front star wheel sprocket 54 from engagement with the midportion 86 of the cartridges 51; and releases the rearward pressure of the spring 70 against the flanged edges of the cartridges 51 thereby positively urging the cartridges out of their respective bores by a recoil action.

The fact that the cartridge release action occurs in response to engagement of the front star wheel 54 with the revolver cylinder accomplishes two primary purposes. First, the lack of any requirement for manual actuation of a cartridge release mechanism independently of grasping the body member 20 allows one hand to maintain its grasp on the body member throughout loading while the other hand maintains its grasp on the revolver. No inconvenient change of position of one hand to grasp a release mechanism is required. More important, the capability of the release mechanism to be actuated by contact with the revolver cylinder enables it to be positioned on the front of the body member recessed and protected by the cartridges from inadvertent actuation. Thus no striking or dropping of the loaded body member against a surface at any angle will release the cartridges.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for the rapid simultaneous loading of a plurality of cartridges, each having a circular flanged peripheral edge at the base thereof, into a revolver having a cylinder with plural loading chambers, comprising:

a. a body member having front and rear opposing surfaces, and means defining a center bore extending generally perpendicularly to said front and rear opposing surfaces and a plurality of cartridge-receiving bores radially distributed around said center bore, each of said plurality of bores extending parallel to said center bore and having a diameter greater than that of said flanged peripheral edges of said cartridges and suitable for receiving and supporting one of said cartridges;

b. cartridge locking means mounted in said center bore adjacent said rear surface of said body member for releasably securing said cartridges in said plurality of bores and urging said cartridges radially inward toward said center bore; and c. cartridge lateral support means mounted in said center bore forwardly of said cartridge locking means for releasably urging said cartridges radially outward against said inward urging of said locking means and thereby centrally positioning each said cartridge within its respective bore in parallelism with said center bore.

2. The device of claim 1, wherein said cartridge lateral support means and said cartridge locking means comprise axially spaced front and rear star sprockets respectively, each having radially projecting portions, for contacting the body of said cartridges and said flanged peripheral edges of said cartridges respectively at longitudinally spaced locations on said cartridges.

3. A device for the rapid simultaneous loading of a plurality of cartridges, each having a circular flanged peripheral edge at the base thereof, into a revolver having a cylinder with plural loading chambers, comprising:

a. a body member having front and rear opposing surfaces, and means defining a center bore extending generally perpendicularly to said front and rear opposing surfaces and a plurality of cartridge-receiving bores radially distributed around said center bore, each of said plurality of bores extending parallel to said center bore and having a diameter greater than that of said flanged peripheral edges of said cartridges and suitable for receiving and supporting one of said cartridges, said body member and said cartridge-receiving bores being of such a length as to cause the leading ends of said cartridges to protrude from said front surface of said body member when supporting said cartridges;

b. cartridge locking means mounted in said center bore and having lock actuating means positioned adjacent said rear surface of said body member for releasably securing said cartridges in said plurality of bores;

c. lock release means positioned adjacent said front surface of said body member and connected to said cartridge locking means for releasing said cartridge locking means in response to the engagement of said lock release means with the cylinder of said revolver; and d. cartridge lateral support means mounted on said lock release means for releasably engaging the sides of said protruding portions of said cartridges.

4. A device for the rapid simultaneous loading of a plurality of cartridges, each having a circular flanged peripheral edge at the base thereof, into a revolver having a cylinder with plural loading, chambers, comprising:

a. a body member having front and rear opposing surfaces, and means defining a center bore extending generally perpendicularly to said front and rear opposing surfaces and a plurality of cartridge-receiving bores radially distributed around said center bore, each of said plurality of bores extending parallel to said center bore and having a diameter greater than that of said flanged peripheral edges of said cartridges and suitable for receiving and supporting one of said cartridges;

b. cartridge locking means mounted in said center bore and having lock actuating means positioned adjacent said rear surface of said body member for releasably securing said cartridges in said plurality of bores; and c. cartridge lateral support means separate and apart from said bore-defining means and mounted in said center bore forwardly of said cartridge locking means for releasably engaging said cartridges at the center of its respective bore in parallel with said bore of said body member.

5. The device of claim 4 wherein said cartridge locking means includes means for releasably urging said cartridges radially inward toward said center bore, and wherein said cartridge lateral support means includes means for releasably urging said cartridges radially outward against said inward urging of said cartridge locking means and thereby centrally positioning each said cartridge within its respective bore in parallelism with said center bore.

6. The device of claim 4, wherein said cartridge lateral support means and said cartridge locking means comprise axially spaced front and rear star sprockets respectively, each having radially projecting portions for contacting the body of said cartridges and said flanged peripheral edges of said cartridges respectively at longitudinally spaced locations on said cartridges.

7. A device for the rapid simultaneous loading of a plurality of cartridges, each having a circular flanged peripheral edge at the base thereof, into a revolver having a cylinder with plural loading chambers, comprising:

a. a body member having front and rear opposing surfaces, and means defining a center bore extending generally perpendicularly to said front and rear opposing surfaces and a plurality of cartridge-receiving bores radially distributed around said center bore, each of said plurality of bores extending parallel to said center bore and having a diameter greater than that of said flanged peripheral edges of said cartridges and suitable for receiving and supporting one of said cartridges;

b. cartridge locking means mounted in said center bore and having lock actuating means positioned adjacent said rear surface of said body member for releasably securing said cartridges in said plurality of bores in response to an applied forward force and subsequent rotary force; and c. lock release means positioned adjacent said front surface of said body member and connected to said cartridge locking means for releasing said cartridge locking means in response to an applied rearward force.

8. The device of claim 7, wherein said cartridge locking means, lock actuating means and lock release means comprise an operating shaft member slidably mounted in said center bore for oscillating longitudinal and rotating movement therein, a rear star sprocket axially and slidably mounted on said shaft member adjacent to said rear surface of said body member and having radially projecting portions for locking said cartridges when rotated into engagement with said cartridges, biasing means mounted on said shaft for urging said rear star sprocket toward said rear face, a lock actuator head mounted on said shaft member adjacent said rear surface and rearwardly of said rear star sprocket having limited axial movement with respect to said shaft member for manual application of forward axial and rotary force to said rear star sprocket to lockingly engage said cartridges, a cam surface formed on said body member adjacent said front surface thereof, and cam means mounted on said shaft member adjacent said front surface of said body member for imparting rotary force to said shaft member by engagement with said cam surface in response to a rearward external force on said shaft member so as to release said locking engagement of said rear star sprocket with said cartridges.

* * * * *

UNITED STATES PATENT AND TRADEMARK OFFICE

CERTIFICATE OF CORRECTION

PATENT NO. : 4,065,868

DATED : January 3, 1978

INVENTOR(S) : David A. Johnson

It is certified that error appears in the above-identified patent and that said Letters Patent are hereby corrected as shown below:

Col. 8 Line 66 After "engaging" insert --each of said cartridges and positioning each of--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,065,868

DATED : January 3, 1978

INVENTOR(S) : David A. Johnson

It is certified that error appears in the above-identified patent and that said Letters Patent are hereby corrected as shown below:

Col. 8, Line 62 — After "bores;", delete the word "and" and insert the following subparagraph:

--c. lock release means positioned adjacent said front surface of said body member and connected to said cartridge locking means for releasing said cartridge locking means in response to the engagement of said lock release means with the cylinder of said revolver; and--

Col. 8, Line 63 — Change "c." to --d.--.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*